US007404228B2

(12) United States Patent
Hodges

(10) Patent No.: US 7,404,228 B2
(45) Date of Patent: Jul. 29, 2008

(54) PAINT ROLLER FRAME

(76) Inventor: David L. Hodges, 318 E. Lake View Dr., Mount Washington, KY (US) 40047

( * ) Notice: Subject to any disclaimer, the term of this patent is extended or adjusted under 35 U.S.C. 154(b) by 118 days.

(21) Appl. No.: 11/228,161

(22) Filed: Sep. 16, 2005

(65) Prior Publication Data

US 2007/0067936 A1 Mar. 29, 2007

(51) Int. Cl.
*B05C 17/02* (2006.01)

(52) U.S. Cl. ..... 15/230.11; 492/13; 492/19

(58) Field of Classification Search ..... 15/230.11; 492/13, 19
See application file for complete search history.

(56) References Cited

U.S. PATENT DOCUMENTS

| | | | | |
|---|---|---|---|---|
| 580,982 | A | | 4/1897 | Marsters |
| 581,581 | A | | 4/1897 | Guthrie |
| 856,733 | A | | 6/1907 | Saffold |
| D119,277 | S | | 3/1940 | Martin et al. |
| 2,548,331 | A | | 4/1951 | Yamashiro |
| 2,680,318 | A | | 6/1954 | Simmons |
| 2,811,733 | A | | 11/1957 | Sloan |
| 2,867,832 | A | | 1/1959 | Hanninen |
| 2,927,334 | A | | 3/1960 | Wonso |
| 3,310,831 | A | | 3/1967 | Brinker |
| 3,369,269 | A | | 2/1968 | Deck et al. |
| 3,386,124 | A | | 6/1968 | Feine |
| 3,593,361 | A | | 7/1971 | Welt |
| 3,604,046 | A | | 9/1971 | Taylor |
| 3,638,939 | A | * | 2/1972 | Langley ..... 482/132 |
| 3,753,267 | A | | 8/1973 | Johnson, Sr. |
| 3,866,257 | A | | 2/1975 | Cansdale, Sr. |
| D239,660 | S | | 4/1976 | Tyson |
| 4,077,082 | A | | 3/1978 | Roe et al. |
| 4,317,248 | A | | 3/1982 | Smith |
| 4,868,946 | A | | 9/1989 | Marino et al. |
| 5,068,951 | A | | 12/1991 | Abrams |
| D334,476 | S | | 4/1993 | Niemackl |
| 5,509,165 | A | | 4/1996 | Zigelboim et al. |
| D396,906 | S | | 8/1998 | Medici |

* cited by examiner

*Primary Examiner*—Randall Chin
(74) *Attorney, Agent, or Firm*—Carrithers Law Office, PLLC; David W. Carrithers

(57) ABSTRACT

A yoke type paint roller frame having a pair of arms joined at one end and each one terminating at the opposite end on which a roller of selected length can be journalled. A cross bar is connected to respective ones of the pair of arms at a preselected location thereon spaced from the roller and is prevented from sliding longitudinally along respective ones of such arms. At least one end of the cross bar is detachably connected to the frame arm associated therewith by a means for connecting such as a snap fit.

11 Claims, 2 Drawing Sheets

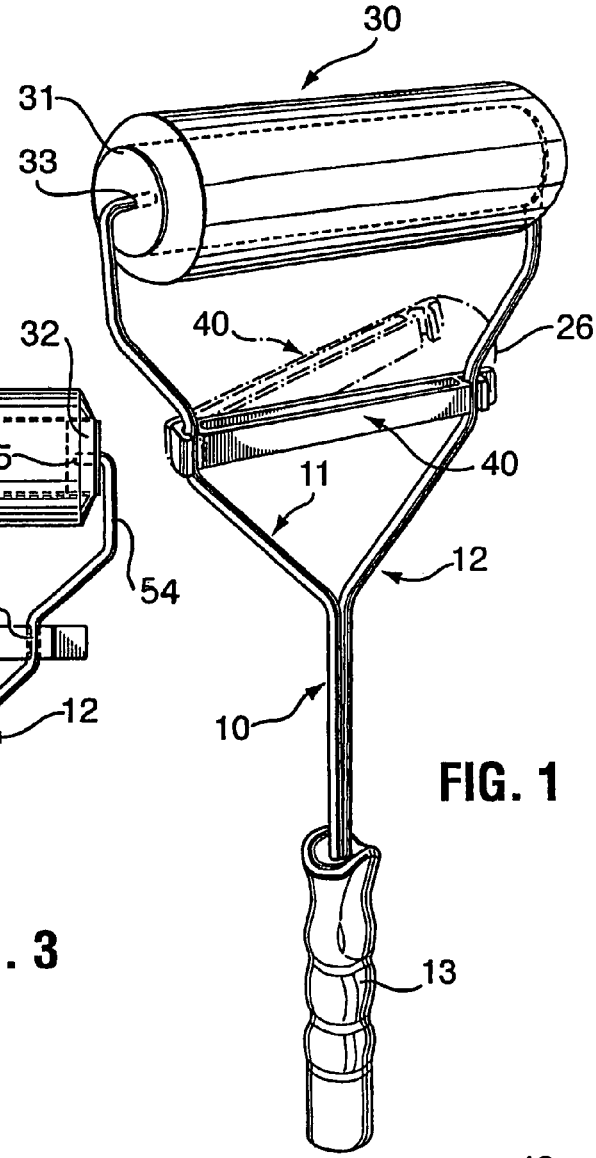
FIG. 1
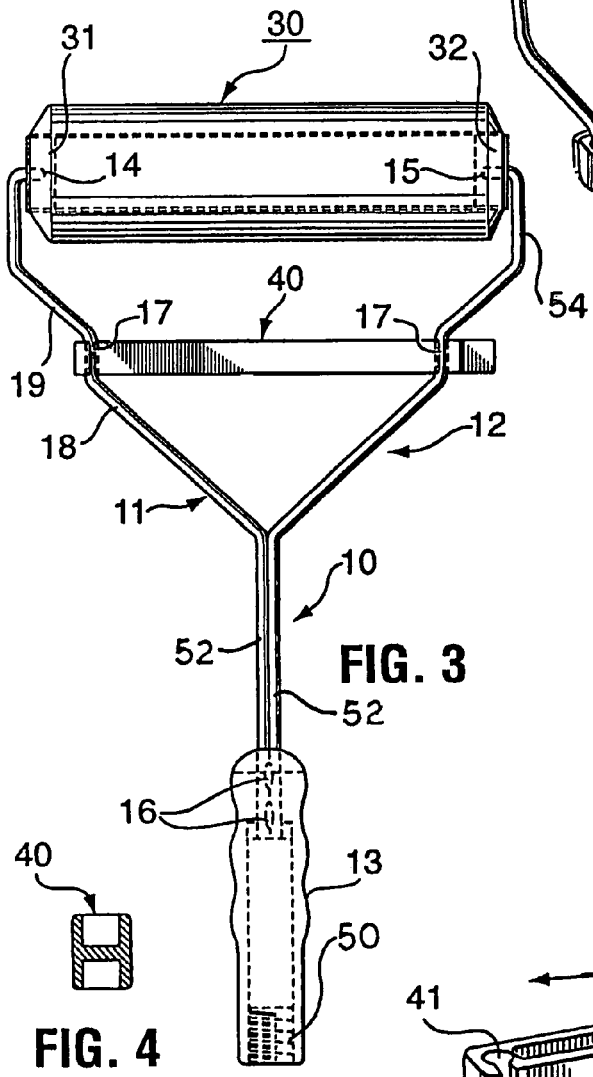
FIG. 3
FIG. 4
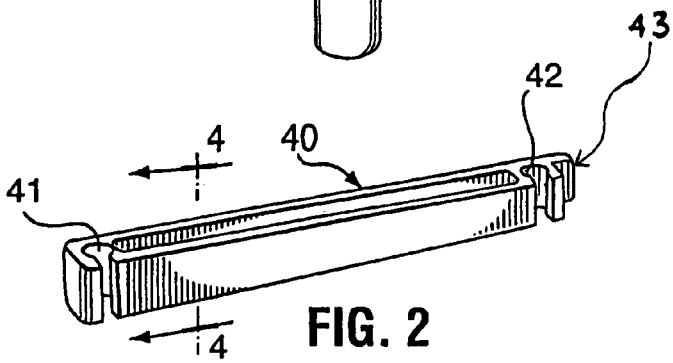
FIG. 2

PAINT ROLLER FRAME

TECHNICAL FIELD

The present invention relates generally to roller type applicators that conventionally have a frame detachably connected to a roller that has a suitable outer face covering to apply a film of liquid to a surface and more particularly to improvements to the frame that makes it rigid while at the same time permitting easy attachment and detachment of the roller. The rigidity of the frame permits having the frame larger for use with rollers that are substantially longer than the conventional 9 and 12 inch rollers.

BACKGROUND OF THE INVENTION

Paint rollers have been used for years to apply a film of liquid paint to a surface leaving a deposited film whose appearance is generally more appealing than if the film had been applied with a brush.

Conventional frames are L-shaped with a handle on the end of one shaft portion and the roller applicator journalled for rotation on the other. The roller may have end caps at opposite ends of the tubular roller and a clip or cap nut is conventionally detachably mounted on the free outer end of the shaft to retain the roller on the shaft. Some form of means is normally provided to keep one end of the roller from abutting against the shaft on which the handle is located.

In another type of roller applicator the end caps are interconnected by a plurality of wires disposed parallel to the shaft and spaced apart from one another circumferentially there around forming a cage that is journalled and retained on the shaft. The roller applicator in this instance is a sleeve that slip fits onto the wire type cage. The distal ends thereof supporting the roller are biased toward one another by the tensile strength of the wire comprising the frame and handle.

In each of the forgoing types of roller applicators the roller pressure will normally be less at the free outer end of the roller that at the end where the shaft and elongate handle are joined. Effectively the shaft with the roller thereon is cantilevered from the elongate handle. This makes them unsuitable for the longer than average roller and dependent upon the tensile strength and/or gauge of the wire frame to bias the distal ends of the frame toward one another supporting the roller there between.

Yoke type of frames are known and by way of example reference may be had to the following United States Patents: Design Patent D334,476 granted Apr. 6, 1993; Design Patent D396.906 granted Aug. 11, 1998; U.S. Pat. No. 581,581 granted Apr. 27, 1897 to M. J. Guthrie; U.S. Pat. No. 2,680,318 granted Jun. 8, 1954 to W. L. Simmons; U.S. Pat. No. 2,811,733 granted Nov. 5, 1957 to M. E. Sloan; U.S. Pat. No. 2,867,832 granted Jan. 13, 1959 to I. Hanninen; U.S. Pat. No. 2,927,334 granted Mar. 8, 1960 to S. Wonso; U.S. Pat. No. 3,310,831 granted Mar. 28, 1967 to W. J. Brinker; U.S. Pat. No. 3,593,361 granted Jul. 20, 1971 to D. I. Welt; U.S. Pat. No. 4,077,082 granted Mar. 7, 1978 to E. O. Roe et al; U.S. Pat. 4,868,946 granted Sep. 26, 1989 to F. Marino et al; U.S. Pat. No. 5,068,951 granted Dec. 3, 1991 to E. M. Abrams; and U.S. Pat. No. 5,509,165 granted Apr. 23, 1996 to I. Zigelbolm.

Yoke type frames allow the user to apply substantially equal pressure at each of opposite ends of the roller. U.S. Pat. No. 3,593,361 and U.S. Pat. No. 4,868,946 teach the yoke arms are adjustably movable toward and away from one another to respectively grasp and release a roller disposed there between. U.S. Pat. No. 2,680,318 and U.S. Pat. No. 2,867,832 teach the free outer ends of the yoke arms are resiliently biased away from one another and are maintained in engagement with the roller by a loop that is slidably disposed on the arms for movement in a direction toward and away from the roller. U.S. Pat. No. 2,811,733 teaches the yoke arms are interconnected by a tension spring that can be made to slide along the arms in a direction toward and away from the roller.

None of the patents teach means for retaining the arm interconnecting means at a preselected location on the yoke arms. U.S. Pat. No. 5,509,165 teaches a rigid yoke frame for rollers that are 2 or 3 feet long rather than the normal 9 or 12 inch roll; however, the yoke arms are interconnected at a selected location but the cross member interconnecting the yoke arms is permanently attached to respective ones of the yoke arms at that location.

SUMMARY OF THE INVENTION

In accordance with the present invention there is provided a paint roller frame having a spaced apart pair of arms terminating respectively in first and second free outer ends for receiving a roller there between, means on said first and second free outer ends for journaling a roller thereon to rotate about the longitudinal axis of the roller, a cross arm interconnecting said pair of arms at a preselected location thereon, means preventing said cross bar from sliding along respective ones of said pair of arms, and means detachably connecting said cross bar to at least one of said pair of arms.

It is an object of the present invention to provide a means of exerting pressure in the middle of the roller cover as well as the side edges eliminating excess roller lines and allowing the user to apply more paint to the painting surface;

It is another object of the present invention to eliminate the problem of having the roller cover slip off of the frame by use of a quick attachment locking device to hold the distal ends of the frame together.

It is another object of the present invention to provide a means to facilitate changing the roller covers with minimum effort for changing colors or roller textures.

It is another object of the present invention to provide means for easy installation of the roller to the frame.

It is another object of the present invention to provide a means for positive engagement and disengagement of the roller by from the distal ends of the frame by use of the locking device.

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 1 is an oblique view of the paint roller frame provided in accordance with the present invention showing portions of the roller and locking device in phantom lines;

FIG. 2 is an oblique view of a locking device used on the frame shown in FIG. 1;

FIG. 3 is a perspective view facing the frame in part section to illustrate some of the details of construction showing a cutaway vie of the handle attachment and the roller attachment in phantom lines;

FIG. 4 is a sectional view taken along section 4-4 in FIG. 3; and

DESCRIPTION OF THE PREFERRED EMBODIMENTS

Figure 5:
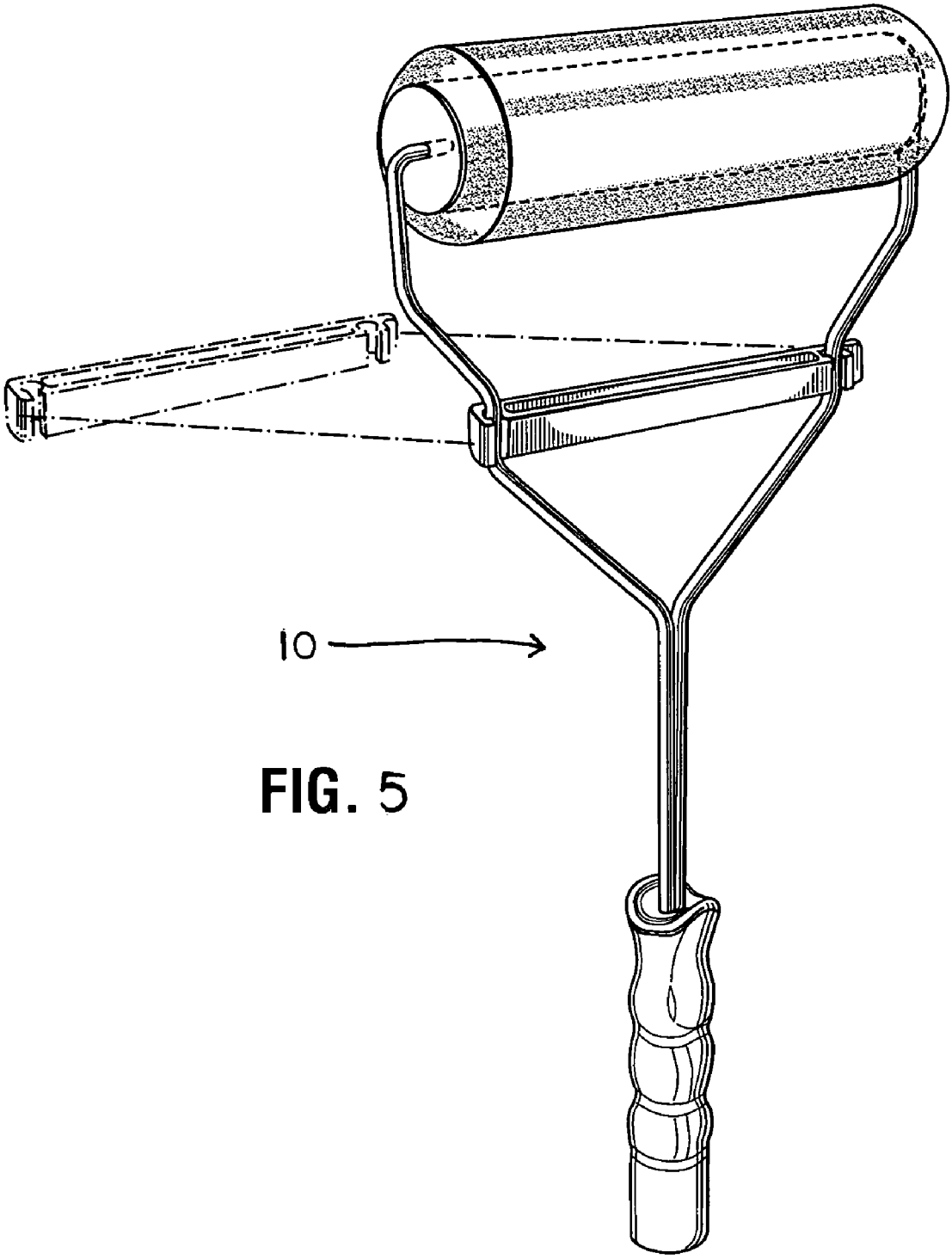
FIG. 5 is a perspective view of the paint roller frame of FIG. 1 showing the frame locking device engaging the frame members and removed from the frame shown in phantom lines to illustrate the snap-on pivot construction detail.

Illustrated in FIG. 1 is a frame 10 having a roller 30 journalled thereon via roller end caps 31, 32 disposed at respective opposite ends of the roller. The roller for example may be a conventional paint roller and thus further description of the same is deemed unnecessary. The end caps illustrated have a centrally disposed hole 33 for receiving therein a stub axle on the frame. In place of the hole there maybe a recess or alternatively a pin may project outwardly from the end cap and into a hole in the terminal end of the frame all of which is known in the art. The particular means of Journaling the roller on the frame is not material to the present invention.

The frame 10 has a pair of arms 11, 12 interconnected at one end thereof and on which end there is mounted a handle 13. The handle 13 has a threaded recess 50 in the free outer end thereon for receiving an extension handle (not shown).

The pair of arms 11, 12 diverge outwardly from one another and terminate at the other distal end in respective stub axles 14, 15 that are pointed inwardly toward one another. The pair of arms 11, 12 may be bent from a continuous length of material such as for example a metal rod to give it an appropriate outline shape or alternatively consist of two identically or similarly shaped pieces disposed as a mirror image of one another and interconnected at the one end by spot welds 16 such as is illustrated in FIGS. 1 or 3.

The spaced apart frame arms 11, 12 are interconnected by a frame locking device comprising a cross bar 40 that snap fits adjacent opposite ends thereof at a preselected location onto respective ones of the pair of arms 11, 12 to hold the pair or arms 11, 12 apart from one another at a selected distance to provide means of adjusting and holding a selected amount of tension on the roller ends by the end caps held by the distal ends stubs axles 14, 15.

The cross bar 40 is an elongate relatively rigid member made of a suitable plastic, wood, fiberglass, metal material. The cross bar 40 can be prevented from sliding along the frame arms 11, 12 by suitable retaining means comprising a notch, projection, o-ring, rubber band, or shape of the frame arm structure. One preferred embodiment of the cross bar 40 is shown in cross-section in FIG. 4 and it is essentially a wide flange I-beam having respective elongate slots 41, 42 disposed adjacent respective opposite ends of the beam. The slots 41, 42 are illustrated as being parallel to one another and perpendicular to the length of the beam. The frame arms 11, 12 are shown having a handle portion defining a pair of contiguous parallel portions 52 which have distal ends which terminate within the handle 13 and proximal portions which veer away from one another at a selected angle defining a first intermediate arm portion 18. Second intermediate arm portions 17 are illustrated being spaced apart and parallel to one another and parallel to the handle portions 52 where the locking device 40 attaches to the them. Third intermediate arm portions 19 veer away from one another starting from the second intermediate arm portion 17 and terminating at a fourth intermediate portion 54 positioned parallel to the handle portion 52 and second intermediate portion 17. The locking device 40 is retained at that preselected location by suitable means that prevents the locking device from moving longitudinally along respective ones of the arms. Such means illustrated in the drawing consists of an arm length second intermediate arm portion 17, where the locking device 40 snaps onto the arm, being disposed between first intermediate arm portion 18 and third intermediate arm portion 19 both of which are disposed at an angle relative to the second intermediate arm portion 17. An elongate slot in the beam comprising the locking device is unable to slide along the angulated portions of the arms 11, 12 and thus the beam is retained in the preselected location on the respective intermediate portion 17 of the arms 11, 12. In the drawing the length of the arm portion 17 between the bends in the respective arms is approximately the same as the length of the respective slots 41, 42 in the device 40.

Of course it is contemplated that a locking device 40 providing a means for holding the arms at a selected position could be used wherein the arms would bow away from the handle and inwardly to support the rollers as well.

The slots 41, 42 are spaced apart from one another an appropriate distance so as keep the stub axles in the hole in the end caps with little or no end play of the roller while at the same time permitting the roller to rotate freely.

Each slot 41, 42 has an entry throat with a gap that is less than the diameter of the rod and thus the device snap fits onto the arms. The device 40 has a finger tab 43 at one end thereof for use in disengaging the device at that end from the arm of the frame so as to allow the user to spread the arms against their resiliency to disengage the roller from the stub axles. The opposite end of the device pivots on the arm portion 17 associated therewith such pivoting being represented in the drawing by the dotted arcuate line 26.

With respect to means to prevent the cross bar 40 from sliding on the arms of the frame each frame arm could be provided with suitably located enlargements or have pins and or washers secured thereto. It s contemplated that instead of welding the two arms together as illustrated by FIG. 4 the two arms could be joined by a tight secure fit to the handle 13.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A roller frame comprising:

a pair of arms joined at one end and each terminating at the opposite end with means for journaling thereon a roller of selected length disposed there between, said arms being spaced apart from one another a selected distance intermediate their opposite ends;

a cross bar connected to respective ones of said arms at a preselected location thereon spaced from a roller journalled on the frame, wherein said cross bar has a pair of elongate spaced apart parallel grooves that receive therein respective ones of said pair of arms; and means preventing said cross bar from sliding longitudinally along respective ones of said pair of arms, at least one end of said cross bar being detachably connected to the frame arm associated therewith permitting replacement of a roller journaled on the frame.

2. The roller frame as defined in claim 1, wherein said means preventing said cross bar from sliding longitudinally along respective ones of said pair of arms are defined by a projection emanating from each arm of the frame in a suitable position to prevent said sliding.

3. The roller frame as defined in claim 1, wherein said means preventing said cross bar from sliding longitudinally along respective ones of said pair of arms are defined by a notch formed into each arm of the frame in a suitable position to prevent said sliding.

4. The roller frame as defined in claim 1, wherein said means preventing said cross bar from sliding longitudinally along respective ones of said pair of arms are defined by an o-ring or rubber band installed on each arm of the frame in a suitable position to prevent said sliding.

5. The roller frame as defined in claim 1, wherein said crossbar is composed of a material selected from the group consisting of a plastic, wood, fiberglass, metal.

6. A roller frame comprising:

a pair of arms joined at one end and each terminating at the opposite end with means for journaling thereon a roller of selected length disposed there between, said arms being spaced apart from one another a selected distance intermediate their opposite ends;

a cross bar connected to respective ones of said arms at a preselected location thereon spaced from a roller journalled on the frame, wherein said cross bar has a pair of elongate spaced apart parallel grooves that receive therein respective ones of said pair of arms;

said grooves have an entry throat with a gap that is smaller than the cross sectional dimension of the arm associated therewith thereby providing a snap fit of the cross bar on to the frame; and means preventing said cross bar from sliding longitudinally along respective ones of said pair of arms, at least one end of said cross bar being detachably connected to the frame arm associated therewith permitting replacement of a roller journaled on the frame.

7. The roller frame as defined in claim 6, wherein said crossbar is composed of a material selected from the group consisting of a plastic, wood, fiberglass, metal.

8. A roller frame comprising:

a pair of arms joined at one end and each terminating at the opposite end with means for journaling thereon a roller of selected length disposed there between, said arms being spaced apart from one another a selected distance intermediate their opposite ends;

a cross bar connected to respective ones of said arms at a preselected location thereon spaced from a roller journalled on the frame, wherein said cross bar has a pair of elongate spaced apart parallel grooves that receive therein respective ones of said pair of arms;

a finger grip tab extending from at least one end of said cross bar used in disengaging the cross bar from the arm of the frame disposed adjacent thereto;

said grooves have an entry throat with a gap that is smaller than the cross sectional dimension of the arm associated therewith thereby providing a snap fit of the cross bar on to the frame; and means preventing said cross bar from sliding longitudinally along respective ones of said pair of arms, at least one end of said cross bar being detachably connected to the frame arm associated therewith permitting replacement of a roller journaled on the frame.

9. The roller frame as defined in claim 8, wherein said crossbar is composed of a material selected from the group consisting of a plastic, wood, fiberglass, metal.

10. A roller frame comprising:

a pair of arms joined at one end and each terminating at the opposite end with means for journaling thereon a roller of selected length disposed there between, said arms being spaced apart from one another a selected distance intermediate their opposite ends; and a cross bar connected to respective ones of said arms at a preselected location thereon spaced from a roller journalled on the frame, wherein each end of said cross bar is detachably connected to a selected length portion of the frame arm permitting replacement of a roller journalled on the frame and wherein said length portion is disposed between two length portions each of which is angularly disposed with respect to said selected length portion and thereby providing means preventing the cross bar from sliding longitudinally along the frame.

11. The roller frame as defined in claim 10, wherein said crossbar is composed of a material selected from the group consisting of a plastic, wood, fiberglass, metal.

* * * * *